United States Patent [19]

Baker et al.

[11] Patent Number: 4,731,969

[45] Date of Patent: Mar. 22, 1988

[54] ROOF TILES

[75] Inventors: Robin M. Baker, Horsham; Paul R. Sargeant, Wisborough Green; Ernest G. Papper, Crawley, all of England

[73] Assignee: Redland Roof Tiles Limited, Reigate, United Kingdom

[21] Appl. No.: 775,414

[22] Filed: Sep. 12, 1985

[30] Foreign Application Priority Data

Sep. 12, 1984 [GB] United Kingdom ..... 8423034

[51] Int. Cl.[4] ..... E04D 1/00

[52] U.S. Cl. ..... 52/536; 52/519; 52/539; 52/542; 52/554

[58] Field of Search ..... 52/519, 533, 536, 550, 52/552, 554, 542, 520, 528, 530, 534, 535, 538, 544, 545, 549, 551

[56] References Cited

U.S. PATENT DOCUMENTS

| | | | |
|---|---|---|---|
| 426,584 | 4/1890 | Donaldson | 52/533 |
| 465,364 | 12/1891 | Donaldson et al. | 52/533 |
| 522,686 | 7/1894 | Donaldson et al. | 52/536 |
| 814,970 | 3/1906 | Leusch | 52/536 |
| 844,453 | 2/1907 | Johnston | 52/533 |
| 1,124,001 | 1/1915 | Elzey | 52/533 |
| 1,226,888 | 5/1917 | Hughes et al. | 52/536 |
| 1,343,792 | 6/1920 | Schmitte | 52/536 |
| 1,397,708 | 11/1921 | Stowell | 52/536 |
| 2,028,228 | 1/1936 | Ludowici | 52/536 |
| 4,262,466 | 4/1981 | Roe | 52/550 |
| 4,372,090 | 2/1983 | Schichijo | 52/536 |

FOREIGN PATENT DOCUMENTS

| | | | |
|---|---|---|---|
| 95420 | 11/1983 | European Pat. Off. | 52/518 |
| 1158191 | 6/1958 | France | 52/536 |
| 1478544 | 4/1967 | France | 52/536 |

*Primary Examiner*—John E. Murtagh
*Assistant Examiner*—Andrew Joseph Rudy
*Attorney, Agent, or Firm*—Beveridge, DeGrandi & Weilacher

[57] ABSTRACT

The invention concerns an extruded concrete roof tile of the kind which is designed to be laid in broken bond, is generally rectangular in plan view and has underlying and overlying side lock portions at opposed edges respectively. The upper surface of the tile at the upper end thereof, when on the roof, is recessed to receive the side locks of two similar upper tiles laid in broken bond, and the underlying side lock portion is cut away at the lower end of the tile so that the lower end portion of the tile may lie over the upper surface of the tiles down the roof (in use) to extend beyond the said recessed portions of the lower tiles. The recessed portion is arranged to receive the tile hanging nibs of an identical tile when the two tiles are stacked one upon the other.

7 Claims, 10 Drawing Figures

ROOF TILES

SUMMARY OF THE INVENTION

This invention is concerned with improvements in roof tiles.

The invention provides an extruded concrete roof tile of a kind which is designed to be laid in broken bond, is generally rectangular in plan view and has underlying and overlying said lock portions at opposed edges respectively, wherein an upper surface of the tile at an upper end thereof, when on a roof, has a recessed portion for receiving the side locks of two similar upper tiles laid in broken bond, and the underlying side lock portion is cut away at a lower end of the tile so that a lower end portion of the tile may lie over the upper surfaces of the tiles down the roof to extend beyond the said recessed portions of the lower tiles.

In a conventional roof made of concrete tiles the lower portions of the tiles overlap upper portions of tiles down the roof. When a roof is viewed from its lower edge one sees edges of the tiles where they overlap and the thickness of the edges (i.e. the height difference between upper surfaces of adjacent tiles up and down the roof) is governed by the amount of material required to provide the sidelocks. It is an advantage of the tile according to the invention that when a roof is viewed from its lower edge, i.e. from the ground, the rooof has the appearance that it is made of thinner tiles than a roof formed with conventional tiles provided with sidelocks.

The invention is particularly applicable to generally flat tiles but it is to be understood that the invention can equally be applied to profiled tiles, for example, those known as double Roman tiles.

Preferably, the recess is provided only in a mid portion across the upper surface of the tile.

Preferably the tile includes tile hanging nibs arranged so that they will be wholly received in the recessed portion of a lower identical tile when the two tiles are stacked one upon the other.

An underside of the tile may be hollowed out except in a region of the recessed portion and the sidelocks. The recessed portion may have a flat portion parallel to the upper surface of the tile.

Preferably the flat portion is at the end of the tile which is the upper end when the tile is on the roof, and is joined to the upper surface of the tile by a sloping portion which is set at such an angle that when the tile is on the roof the sloping portion slopes downwardly so that water will always drain from the recessed portion.

There now follows, by way of example, a detailed description of a tile according to the invention, which description is to be read with reference to the accompanying drawings in which:

DESCRIPTION OF THE PREFERRED EMBODIMENT

Figure 1:
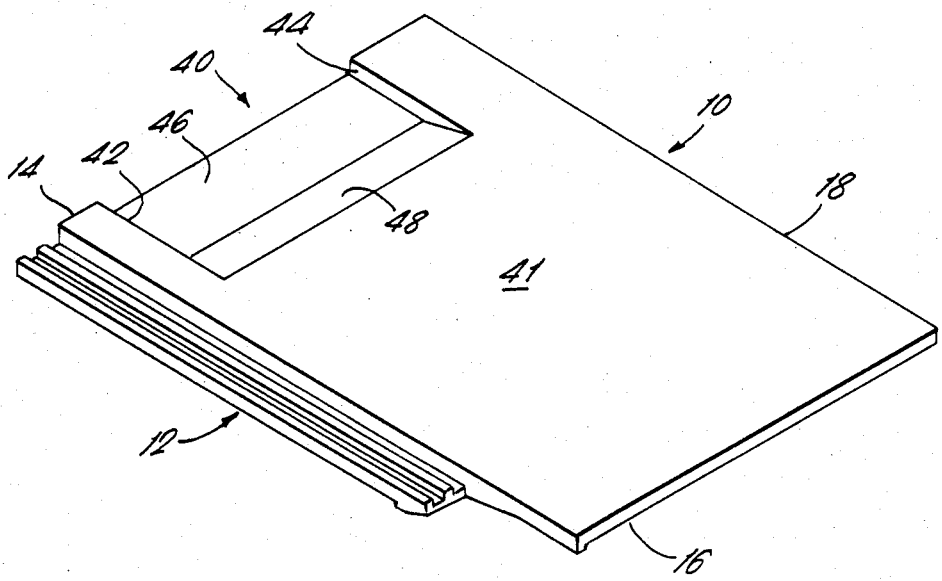
FIG. 1 is an upper perspective view of a roof tile.

Referring to FIGS. 1 to 7, an extruded concrete roof tile 10 is generally rectangular in plan and comprises at the left hand side thereof, as viewed in FIG. 1, an underlying side lock portion 12 which faces upwardly and extends from the end 14 of the tile 10 which, in use, is the upper end of the tile, for about threequarters of the length of the tile, or more, towards the lower end 16 thereof. It will be seen (especially in FIG. 2) that the underside of the side lock portion 12 is chamfered at its lower end 12*a*. This shaping of the undersurface allows for a small discrepancy in the optimum spacing between adjacent roof battens.

Figure 2:
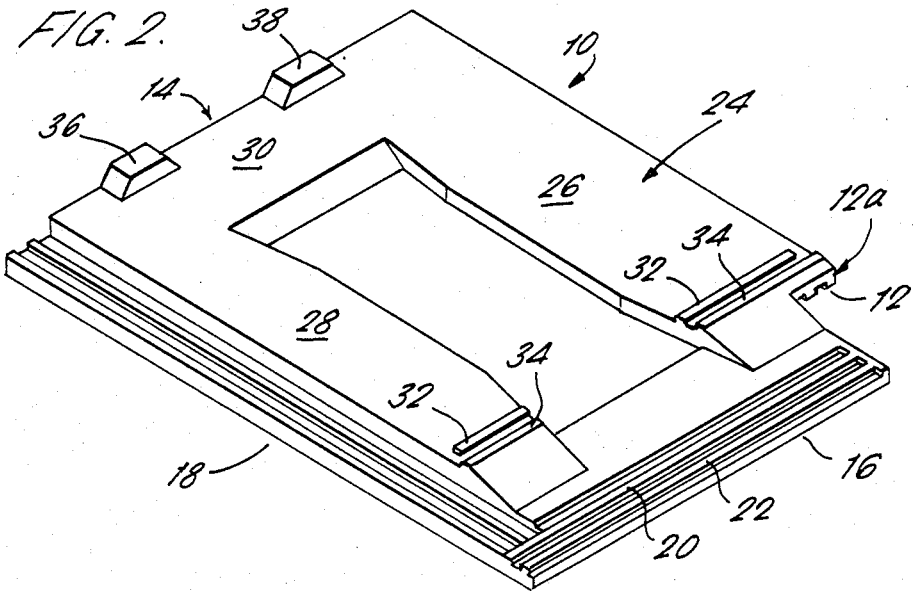
FIG. 2 is an underside perspective view of the tile of FIG. 1.

The tile 10 also comprises at the right hand side thereof, as viewed in FIG. 1, an overlying side lock portion 18 which faces downwardly and extends for substantially the whole length of the tile 10 (see FIG. 2). The side lock portion 18 terminates short of the lower end 16 of the tile at a pair of transverse ribs 20 and 22, which ribs extend across the undersurface of the tile adjacent the lower end 16 thereof, see also FIGS. 6 and 7. The ribs 20 and 22 strengthen the tile and act as weatherbars when tiles of the invention are arranged in overlapping arrangement on a roof.

The underside 24 of the tile 10 is shaped by the pallet on which it is formed and, although the tile so formed has a nominal thickness which is apparent from viewing the lower end 16 of the tile (see FIG. 1), it also comprises two thickened portions 26 and 28 which are located inwardly of the side lock portions 12 and 18 respectively. The portions 26 and 28 extend downwardly (see FIG. 2) from a thickened head portion 30 of the tile 10 to a position which is substantially coincident with the lower end 12*a* of the side lock portion 12.

Figure 6:
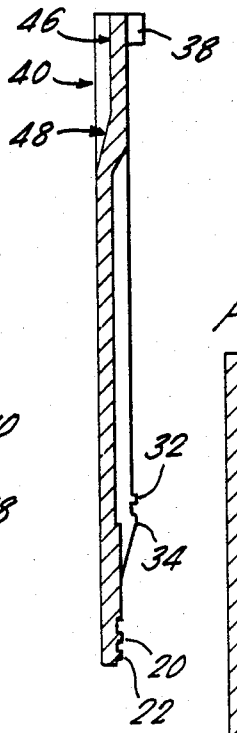
FIGS. 4, 5, 6 and 7 are section views taken on the lines IV—IV, V—V, VI—VI and VII—VII in FIG. 3.
Figure 7:
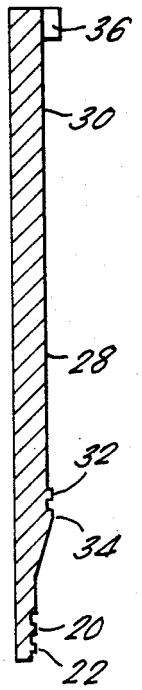
Figure 4:
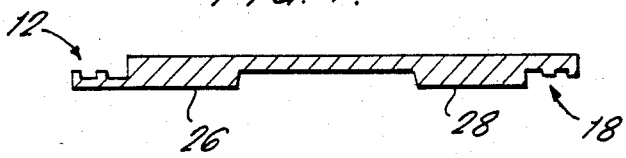
Figure 5:
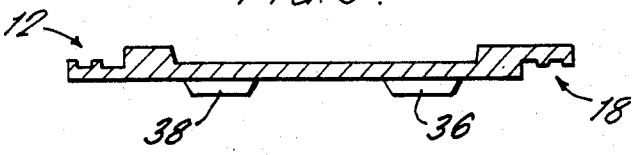

The portions 26 and 28 thus provide strength to the tile 10 and each has a pair of co-extensive parallel transverse ribs 32 and 34 at its lower end portion, see FIGS. 2, 6 and 7. The ribs 32 and 34 add further strength to the tile 10 and also act as weatherbars when tiles of the invention are arranged in overlapping arrangement on a roof.

At the head of the tile 10 on the underside thereof, hanging nibs 36 and 38 of known configuration are provided whereby the tile may be hung from roof battens in the conventional manner.

Figure 3:
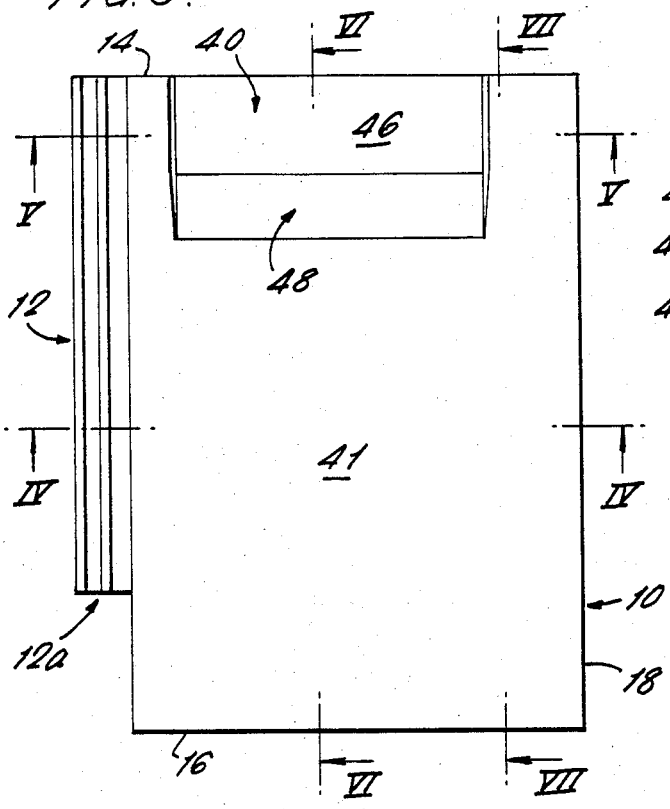
FIG. 3 is a plan view of the tile of FIG. 1.

The tile 10 further comprises a channel or recess 40 formed in its upper surface and extending from the upper end 14 thereof, see FIGS. 1, 3 and 6. The channel 40 is open ended at the end 14 of the tile and comprises angled side walls 42 and 44 adjacent to the side lock portions 12 and 18 respectively, the channel 40 also having a floor extending between said walls 42 and 44 which floor has a flat portion 46 adjacent the end 14 of the tile and a sloping portion 48 which extends from the flat portion 46 to the upper surface 41 of the tile as shown in the Figures referred to. The angle of the portion 48 is such that when the tile is on a roof the portion 48 is inclined downwardly to allow water to drain from the channel 40.

In use the channel 40 of one tile 10 is effective to receive the lower end portions of the thickened portions or ribs 26 and 28 of two sideways adjacent tiles 10 located in broken bond relationship thereabove. The effect is to telescope together the thicknesses of adjacent tiles and allow the lower ends 16 of the tiles above to overlie the tile below and give the appearance of the tiles being half as thick as they actually are, when view from the ground.

Figure 8:
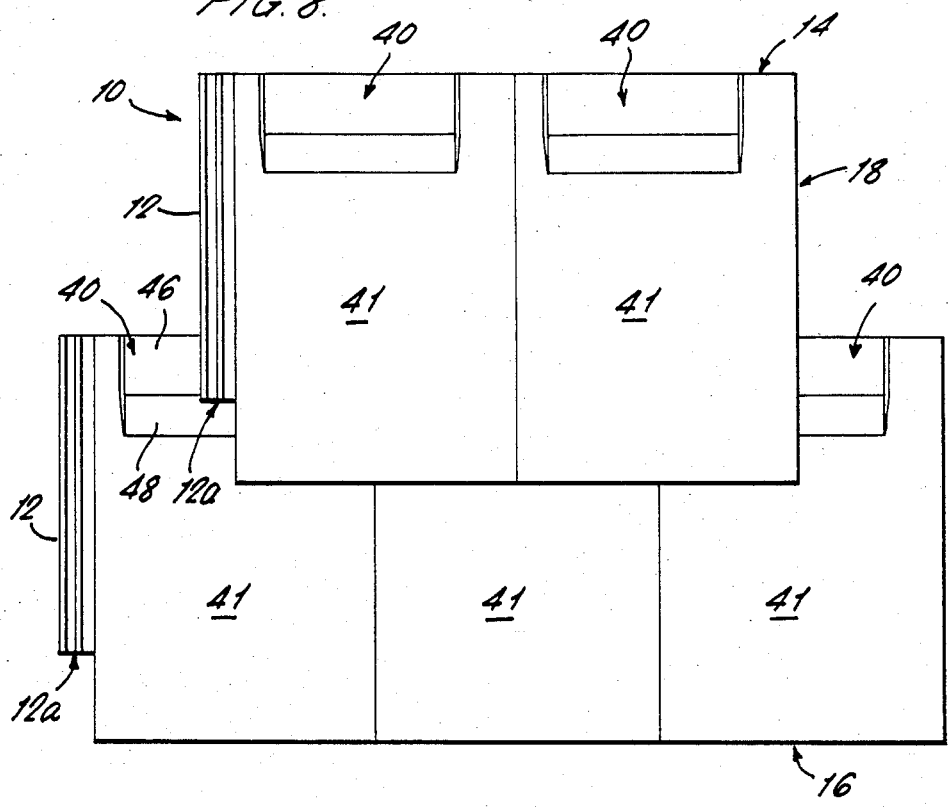
FIG. 8 is a view from above of part of a roof formed from tiles shown in FIG. 1.

In addition the sideways adjacent tiles 10 interengage at the side locks 12 and 18 but as the underlying parts of the sidelocks do not extend the full length of the tiles the lower end portions 16 of the tiles have no sidelocks. Thereby the lower end portions of sideways adjacent tiles may lie over the upper surfaces 41 of the tiles down the roof to extend beyond the recessed portions 40 of the lower tiles, see FIG. 8.

The whole effect is pleasing to the eye and provides a novel roof tile concept which readily lends itself to modern roofing trends.

Figure 9:
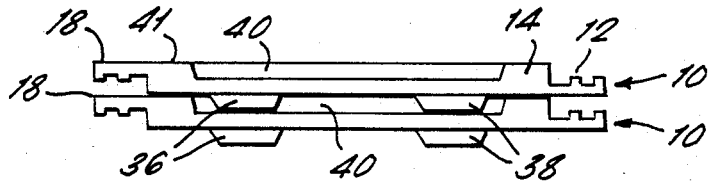
FIG. 9 shows the upper ends of two tiles of FIG. 1 when stacked one upon the other.
Figure 10:
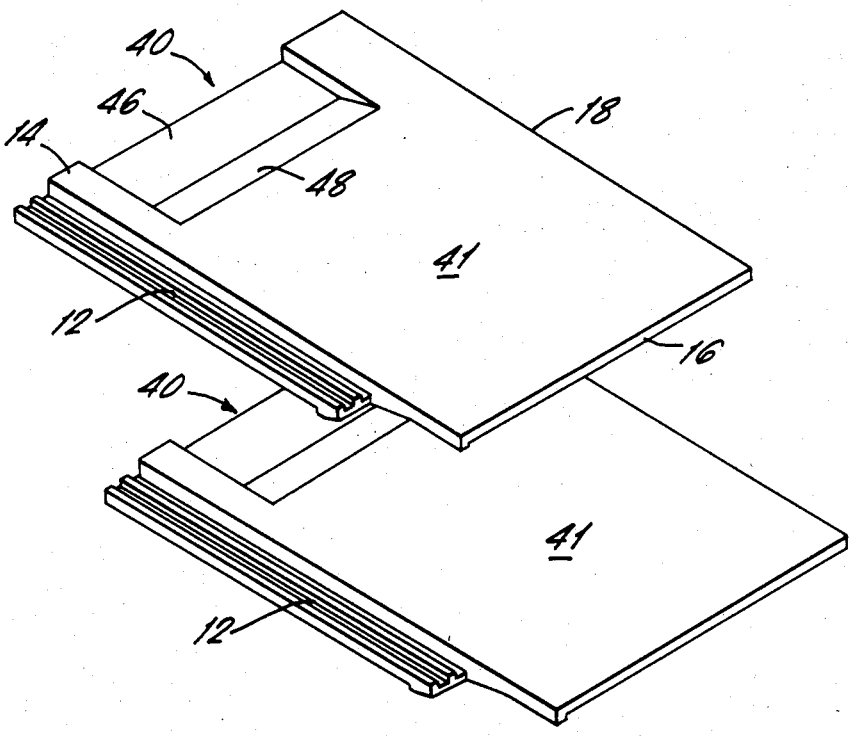
FIG. 10 is an isometric view showing two tiles of FIG. 1 stacked one upon the other when installed on a roof.

A further feature of the novel tile 10 is that the tile hanging nibs 36 and 38 are of such a depth and width that when two tiles are stacked one upon the other (see FIG. 9), the nibs of the upper tile are received within the channel 40 of the lower tile. Thereby the tiles may be stacked directly one upon another and all directed the same way, instead of being staggered with alternate tiles being reversed.

The novel tile 10 may conveniently be made by the method and apparatus disclosed in our co-pending patent application Ser. No. 06/775414 filed Sept. 12, 1985, now U.S. Pat. No. 4,695,418 entitled "Method and apparatus for manufacturing roof tiles and tiles made thereby".

What is claimed is:

1. An extruded concrete roof tile of a kind which is designed to be laid in broken bond, is generally rectangular in plan view and has underlying and overlying sidelock portions at opposed edges respectively, wherein an upper surface of the tile is generally flat, said tile having an upper end provided with an upwardly facing recessed portion adapted to received the sidelocks of two similar upper tiles laid in broken bond, said recessed portion being recessed beneath the flat upper surface of the tile, and the underlying sidelock portion is cut away at a lower end of the tile so as not to extend beyond the recessed portion of a tile positioned therebeneath when laid on a roof, said generally flat upper surface of the tile having a lower end portion which extends downwardly from the recessed portion and is positioned to lie over upper surfaces of a lower tile down the roof and positioned to extend beyond the said recessed portion of the lower tile.

2. A tile as claimed in claim 1, in which the recess extends only for a mid portion across the upper surface of the tile.

3. A tile as claimed in claim 1 including tile hanging nibs arranged so that they will be wholly received in the recessed portion of a lower identical tile when the two tiles are stacked one upon the other.

4. A tile as claimed in claim 1 in which an underside of the tile is hollowed out except in a region of the recessed portion and the sidelocks.

5. A tile as claimed in claim 1 in which the recessed portion has a flat portion parallel to the upper surface of the tile.

6. A tile as claimed in claim 5, in which the flat portion is at the end of the tile which is the upper end when the tile is on the roof, and is joined to the upper surface of the tile by a sloping portion which is set at such an angle that when the tile is on the roof the sloping portion slopes downwardly so that water will always drain from the recessed portion.

7. A roof, said roof including an upper tile and a lower tile, said tiles being laid in broken bond and being identical to each other, each said tile being generally rectangular in plan view and having an upper end, a lower end and two side edges, each said tile having underlying and overlying sidelock portions at opposed said side edges, each tile having its underlying sidelock portion spaced from the lower end of said tile, each said tile having an upper surface which has a recessed portion and a generally flat portion which extends downwardly from said recessed portion, said recessed portion being recessed beneath the generally flat portion, said upper tile having its underlying sidelock portion disposed in said recessed portion of the lower tile without extending downwardly beyond the recessed portion of the lower tile, said upper tile having its lower end spaced downwardly from the recessed portion of the lower tile so that the flat portion of the upper surface of the upper tile extends down the roof beyond the recessed portion of the lower tile.

* * * * *